US006986631B2

(12) United States Patent
Cobene, II et al.

(10) Patent No.: US 6,986,631 B2
(45) **Date of Patent: *Jan. 17, 2006**

(54) SYSTEMS AND METHODS OF BINDING A TEXT BODY

(75) Inventors: Robert L. Cobene, II, Santa Clara, CA (US); Steven W. Trovinger, Los Altos, CA (US); Ross R. Allen, Belmont, CA (US); Raymond G. Schuder, Menlo Park, CA (US); John P. Ertel, Portola Valley, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 313 days.

This patent is subject to a terminal disclaimer.

(21) Appl. No.: 10/603,111

(22) Filed: Jun. 24, 2003

(65) Prior Publication Data

US 2004/0009054 A1 Jan. 15, 2004

Related U.S. Application Data

(62) Division of application No. 09/776,251, filed on Feb. 3, 2001, now Pat. No. 6,619,900.

(51) Int. Cl.
*B42C 9/00* (2006.01)

(52) U.S. Cl. ..... 412/1; 412/8; 412/37; 412/902; 412/900

(58) Field of Classification Search ..... 412/6, 412/8, 37, 902, 900, 33, 16; 156/578
See application file for complete search history.

(56) References Cited

U.S. PATENT DOCUMENTS

| | | | | |
|---|---|---|---|---|
| 3,939,513 | A | 2/1976 | Crathern, III et al. | |
| 5,129,772 | A | 7/1992 | Slautterback | |
| 5,152,654 | A | 10/1992 | Luhman et al. | |
| 5,213,462 | A | 5/1993 | Loibl | |
| 5,271,794 | A | 12/1993 | Jarrell et al. | |
| 5,316,424 | A | 5/1994 | Luhman et al. | |
| 5,346,350 | A | 9/1994 | Luhman et al. | |
| 5,536,044 | A | 7/1996 | Luhman et al. | |
| 6,024,525 | A | 2/2000 | Yamanaka | |
| 6,056,493 | A * | 5/2000 | Hartwig et al. | 412/8 |
| 6,619,900 | B2 * | 9/2003 | Cobene et al. | 412/1 |

FOREIGN PATENT DOCUMENTS

| | | |
|---|---|---|
| JP | 5270168 | 10/1993 |
| JP | 6048065 | 2/1994 |
| JP | 8324153 | 12/1996 |
| WO | WO 99/38707 | 8/1999 |

* cited by examiner

*Primary Examiner*—Willmon Fridie, Jr.

(57) ABSTRACT

Systems and methods for binding a text body are described. A multi-function sheet binder is configured to heat a preformed solid hot melt adhesive to a melting temperature, form the melted adhesive by pressing the melted adhesive into a spine of a text body and folding down edges of the melted adhesive into contact with the text body, and actively cool the formed adhesive. A spot heater is configured to heat one or more localized areas of a solid hot melt adhesive to a temperature sufficient to tack the hot melt adhesive to a text body spine. An adhesive former is configured to press a localized region of a preformed heated solid hot melt adhesive into a spine of a text body and to fold down edge regions of the preformed solid hot melt adhesive into contact with the text body.

29 Claims, 10 Drawing Sheets

SYSTEMS AND METHODS OF BINDING A TEXT BODY

CROSS REFERENCE TO RELATED APPLICATIONS

This is a divisional of application Ser. No. 09/776,251 filed on Feb. 3, 2001 now U.S. Pat. No. 6,619,900, which is hereby incorporated by reference herein.

This application relates to co-pending U.S. patent application Ser. No. 09/721,549 filed Nov. 24, 2000, by Robert L. Cobene et al., and entitled "SYSTEMS AND METHODS OF ATTACHING A COVER TO A TEXT BODY," and to co-pending U.S. patent application Ser. No. 09/728,003 filed Dec. 1, 2000, by Robert L. Cobene et al., and entitled "SYSTEMS AND METHODS OF INCREASING BINDING STRENGTH OF A BOUND TEXT BODY," both of which are incorporated herein by reference.

TECHNICAL FIELD

This invention relates to systems and methods of binding sheets into a bound text body.

BACKGROUND

Today, a variety of different bookbinding systems can deliver professionally bound documents, including books, manuals, publications, annual reports, newsletters, business plans, and brochures. A bookbinding system generally may be classified as a commercial (or trade) bookbinding system that is designed for in-line manufacturing of high quality volume runs or an in-house (or office) bookbinding system designed for short "on-demand" runs. Commercial bookbinding systems generally provide a wide variety of binding capabilities, but require large production runs (e.g., on the order of thousands of bindings) to offset the set-up cost of each production run and to support the necessary investment in expensive in-line production equipment. Office bookbinding systems, on the other hand, generally involve manual intervention and provide relatively few binding capabilities, but are significantly less expensive to set up and operate than commercial bookbinding systems, even for short on-demand production runs of only a few books.

In general, a bookbinding system collects a plurality of sheets (or pages) into a text body (or book block) that includes a spine and two side hinge areas. The bookbinding system applies an adhesive to the text body spine to bind the sheets together. A cover may be attached to the bound text body by applying an adhesive to the side hinge areas or the spine of the text body, or both. The cover of a typical commercial soft cover book generally is attached to the text body spine. The covers of hardcover books and some soft cover "lay flat" books, on the other hand, typically are attached to the side hinge areas of the text body and are not attached to the text body spines (i.e., the spines are "floating").

Many different systems have been proposed for applying adhesive to a text body spine to bind the text body sheets together.

For example, U.S. Pat. No. 6,024,525 describes a bookbinder that includes a tape heating apparatus with a main heater and a pair of side heaters. The main heater is configured to preheat the entire length of a hot melt adhesive tape. After the spine of a text body is pressed against the preheated hot melt adhesive tape, the pair of side heaters press the overhanging sides of the adhesive tape against the text body to complete the binding of the sheets into a bound text body.

U.S. Pat. No. 5,346,350 discloses an apparatus for binding sheets that includes an aligning plate that aligns the sheets at the spine edge, and two clamping plates that hold the sheets during binding. A heating platen heats and melts a backless solid hot melt adhesive that is placed along the sheet edges. The hot melt adhesive binds the sheets together at the spinal area. According to the '350 patent:

> Capillary action is the preferred primary mechanism by which the adhesive flows into the stack 12 to bond the paper sheets together. Capillary action assists both the adhesion of the adhesive material 94 to the stack of paper 12 and the internal cohesion within the adhesive material 94. . . .
>
> Additionally, the platen 120 of the heating subsystem 118 does not push the adhesive 94 into the edge 13 of the stack 12. Ideally, the platen 120 applies zero pressure against the stack 12 and only contacts the adhesive material sheet 94 sufficiently to melt the adhesive 94 so that the gravity-assisted capillary action causes the liquid adhesive 94 to wick into and bond the stack 12 together. Putting pressure on the adhesive 94 in an attempt to push it into the stack 12, whether pushing downwardly, upwardly, or sideways, would not enhance bonding. Rather, this would squeeze the adhesive off of the edge 13 and off of the stack 12 through the sides between the platen 120 and the stack 12 and defeat the effects of capillary action. Thus, the platen is designed to apply only minimal pressures on the edge 13 of the stack 12 to maintain contact between the platen 120, the adhesive 94 and the stack 12.
>
> (Col. 8, line 60 through col. 9, line 29)

The hot melt adhesive also may be used to attach a preformed book cover to the text body spine.

International Patent Publication No. WO 99/38707 discloses a paperback bookbinding scheme in which a cover with an adhesive strip disposed along a spine area is forced between a pair of pressing rollers to form a pocket, and a text body is inserted into the pocket with the text body spine in contact with the adhesive strip. The pressing rollers move forcibly toward one another to compress the cover firmly against the front and back sides of the text body and to compress the text body sheets together tightly in the area adjacent to the spine. A sonic tool transmits sonic energy to the cover to activate the adhesive strip and, thereby, bind the text body sheets and the cover into a perfectly bound book.

U.S. Pat. No. 4,911,475 discloses a bookbinding construction in which sheets are bound together into a book block by two or more spaced-apart transverse segments of adhesive. The front section of a cover is attached to the first page of the book block and the back section of the cover is secured to the last page of the book block. Upon opening the book or turning a page, glue-free portions of the spine edge of the open page flex or bow outward over the facing page in a wedging manner or interfering fit. According to the '475 patent, this wedging action against the opposite page resists the tendency of the book to spring closed and forces the pages of the book to lie flat.

U.S. Pat. No. 5,271,794 discloses an adhesive applicator that is configured to spread coat an adhesive onto the spine and side edges of a text body to bind the text body sheets and a cover into a perfectly bound book with an attached spine. The adhesive applicator includes a book spine coating nozzle with adjustable side sealing jaws for adjusting the nozzle width for different book thicknesses and separate side glue outlets for depositing glue on the book sides. Glue flow control valves are disposed between the spine coating nozzle and the side glue outlets so the glue deposited on the book sides may be selectively and independently cut off or controlled.

Still other bookbinding systems have been proposed.

SUMMARY

The invention features novel systems and methods of binding sheets into a bound text body.

In one aspect, the invention features a multi-function sheet binder configured to heat a preformed solid hot melt adhesive to a melting temperature, form the melted adhesive by pressing the melted adhesive into a spine of a text body and folding down edges of the melted adhesive into contact with the outer sheets of the text body, and actively cool the formed adhesive.

The multi-function sheet binder may comprise a tool carrier having separate sides respectively supporting an adhesive heater tool, an adhesive former tool and an adhesive cooler tool. The tool carrier preferably is rotatable about an axis so that the separate tools of the tool carrier respectively may be positioned to act upon a preformed solid hot melt adhesive disposed over the text body spine.

In another aspect, the invention features a spot heater configured to heat one or more localized areas of a solid hot melt adhesive to a temperature sufficient to tack the hot melt adhesive to a text body spine.

Embodiments in accordance with this aspect of the invention may include one or more of the following features.

The spot heater preferably comprises an elongated clamp supporting one or more spaced apart heating elements.

The system may include a solid hot melt adhesive dispensing system that incorporates the spot heater and is configured to dispense a solid hot melt adhesive over the text body spine and some portion of the outer pages of the text body, and to cut dispensed adhesive to width.

In another aspect, the invention features an adhesive former configured to press a localized region of a preformed heated solid hot melt adhesive into a spine of a text body and to fold down edge regions of the preformed solid hot melt adhesive into contact with the outer sheets of the text body.

Embodiments in accordance with this aspect of the invention may include one or more of the following features.

The adhesive former preferably comprises a compliant roller configured to press the localized region of the preformed heated solid hot melt adhesive into the text body spine. The adhesive former preferably also comprises a pair of pinch rollers configured to fold down edge regions of the preformed solid hot melt adhesive into contact with the text body.

The adhesive former preferably is configured to traverse the text body spine.

In another aspect, the invention features a sheet binding method in accordance with which a multifunction sheet binder, which comprises a tool carrier having separate sides respectively supporting an adhesive heater, an adhesive former and an adhesive cooler, is advanced over a preformed-solid hot melt adhesive disposed over a spine of a text body. The preformed solid hot melt adhesive is heated to a melting temperature with the adhesive heater. The frame then rotates to present the adhesive former. The melted adhesive is formed with the adhesive former by pressing the melted adhesive into the text body spine and folding down edges of the melted adhesive into contact with the text body. The frame then rotates to present the adhesive cooler, which cools the formed adhesive.

In another aspect, the invention features a method of binding sheets into a bound text body. In accordance with this inventive method, a solid hot melt adhesive is dispensed over a spine of a text body. One or more localized areas of the dispensed adhesive are heated to a temperature sufficient to tack the hot melt adhesive to the text body spine. The tacked adhesive is cut to width.

Embodiments in accordance with this aspect of the invention may include one or more of the following features.

The cut adhesive preferably is heated to a melting temperature. The melted adhesive preferably is formed by pressing the melted adhesive into the text body spine and folding down edges of the melted adhesive into contact with the outer sheets of the text body. A localized region of the melted adhesive (e.g., a centrally located region of the text body spine) preferably is formed to the text body spine and, subsequently, remaining regions of the melted adhesive are formed to the text body spine.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
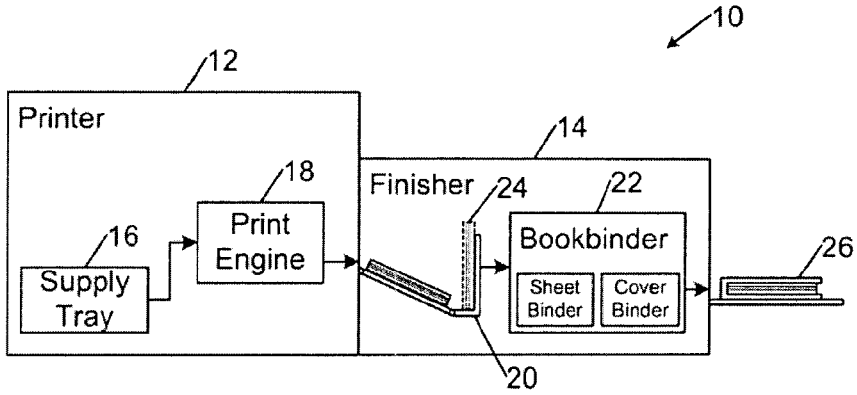
FIG. 1 is a diagrammatic side view of a bookbinding system.

Referring to FIG. 1, in one embodiment, a bookbinding system 10 includes a printer 12 and a finisher 14. Bookbinding system 10 may be implemented as a desktop or office bookmaking system designed to satisfy on-demand bookbinding needs. Printer 12 may be a conventional printer (e.g., a LaserJet® printer available from Hewlett-Packard Company of Palo Alto, Calif., U.S.A.) that includes a supply tray 16 that is configured to hold a plurality of sheets (e.g., paper sheets), and a print engine 18 that is configured to apply markings onto the sheets received from supply tray 16. Finisher 14 includes a sheet collector 20 and a bookbinder 22. Bookbinder 22 includes a sheet binder that is configured to bind the text body sheets to one another, and a cover binder that is configured to attach a cover to the bound text body. In operation, sheets are fed from supply tray 16 to print engine 18, which prints text, pictures, graphics, images and other patterns onto the sheets. The printed sheets are fed to sheet collector 20, which collects and aligns the sheets into a text body 24 with an exposed spine bounded by two exposed side hinge areas. The text body 24 is conveyed to bookbinder 22. The sheet binder binds the sheets of text body 24, and the cover binder attaches a cover to the bound text body to produce a bound book 26 with a floating spine or an attached spine.

Figure 2A:
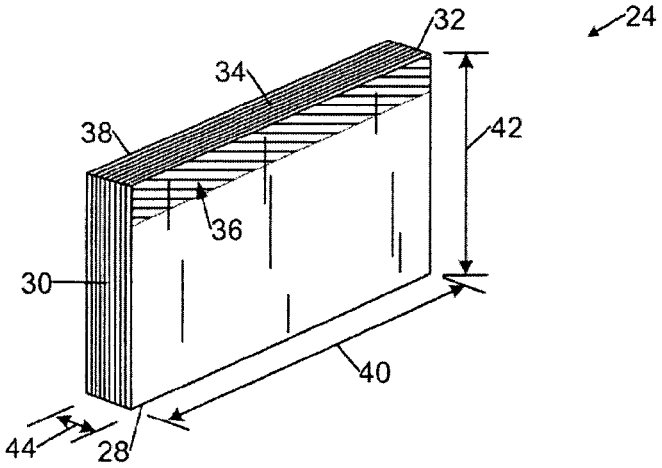
FIG. 2A is a diagrammatic perspective view of a text body formed by collecting and aligning a plurality of sheets.
Figure 2B:
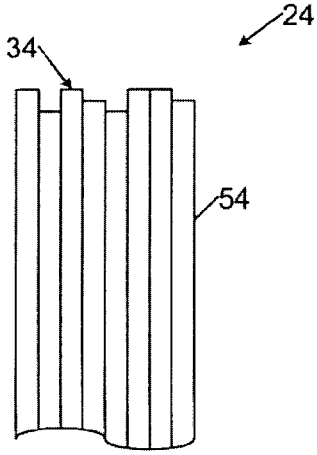
FIG. 2B is a diagrammatic end view of the spinal portion of a text body formed by registering sheets with respect to two datum edges so that variations in sheet width dimension are accommodated in the spine edge of the text body.

Referring to FIGS. 2A and 2B, text body 24 includes a plurality of sheets and is characterized by a front end 28, two sides 30, 32 and a spinal area (or spine) 34, which is located opposite to front end 28. Spine 34 is bounded by two side hinge areas 36, 38. Text body 24 may be characterized by a height dimension 40, a width dimension 42, and a thickness dimension 44. As shown in FIG. 2B, the spinal area exposed for adhesive penetration may be increased before adhesive is applied by registering and aligning text body sheets 54 with respect to two datum edges. In particular, sheets 54 preferably are aligned with reference to front end 28 of text body 24 and one of the two text body sides 30, 32 so that variations in sheet dimensions are accommodated in the text body width dimension 42 of spinal area 34. As a result, the spinal surface area exposed for adhesive penetration is greater than if all of the sheets 54 were registered and aligned with respect to spine edge 34. Upon cooling, the hot melt adhesive re-solidifies and binds the sheets 54 into a bound text body. A variety of different hot melt adhesive compositions may be used to bind the text body sheets, including a conventional paper-backed hot melt sheet adhesive that may be dispensed from a roll and may be obtained from Minnesota Mining and Manufacturing Company (3M), of St. Paul, Minn., United States.

Figure 3:
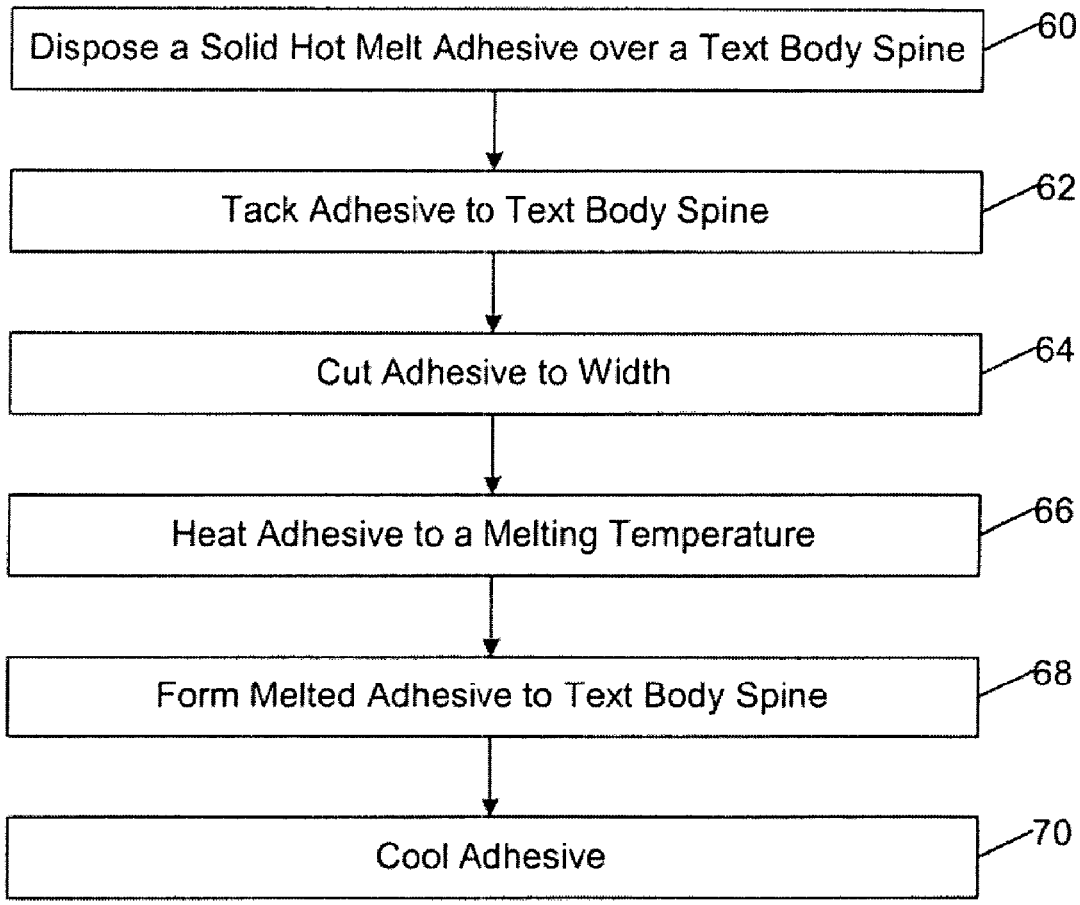
FIG. 3 is a flow diagram of a method of binding sheets into a bound text body.

Referring to FIG. 3, in one sheet binding embodiment, text body 24 may be bound with a solid hot melt adhesive as follows. An adhesive dispensing system disposes a solid hot melt adhesive over text body spine 34 (step 60). A spot heater tacks the dispensed adhesive to the text body spine (step 62). The adhesive dispensing system cuts the adhesive to width, leaving a preformed solid hot melt adhesive tacked to text body spine 34 (step 64). An adhesive heater heats the preformed solid hot melt adhesive to a temperature at or above the melting temperature of the adhesive (step 66). The melted adhesive conforms to the exposed surface features of spinal area 34 and flows into spaces between the ends of sheets 54. An adhesive former forms the melted adhesive to text body spine 34 (step 68). An adhesive cooler cools the formed adhesive until the adhesive re-solidifies to bind the text body sheets into a bound text body (step 70). The resulting bonds between text body sheets 54 are greater than the bonds that would have been formed had the sheets been registered and aligned at spine edge 34.

As shown in FIGS. 4A–4D, in one embodiment, an adhesive dispensing system 72 includes a cartridge housing 74 that includes a supply spool 76 supporting a roll of a paper-backed solid hot melt adhesive 78, Hot melt adhesive 78 is dispensed through a guide slot 80 formed in housing 74. Opposed drive wheels 82, 84 draw hot melt adhesive 78 through guide slot 80. Adhesive dispensing system 72 also includes a spot heater 86 that is configured to heat one or more localized areas of hot melt adhesive 78 to a temperature that is sufficient to tack the adhesive to text body spine 34. Spot heater 86 includes an elongated clamp 88 that supports one or more exposed spaced-apart heating elements (e.g., conventional heating strips or resistive wires). The spacing between heating elements may be on the order of 1–4 cm. A cutting wheel 90 is configured to cut hot melt adhesive 78 to width by traversing a cutting edge of a cutter bar 92.

Figure 4A:
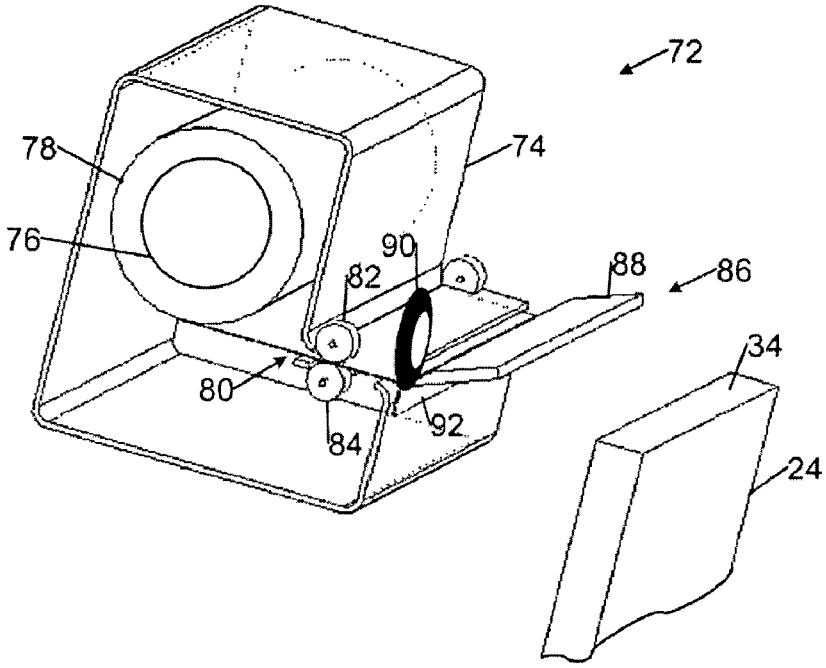
FIG. 4A is a diagrammatic perspective view of an adhesive dispensing system that incorporates a spot heater that is configured to tack a solid hot melt adhesive to a text body spine.
Figure 4B:
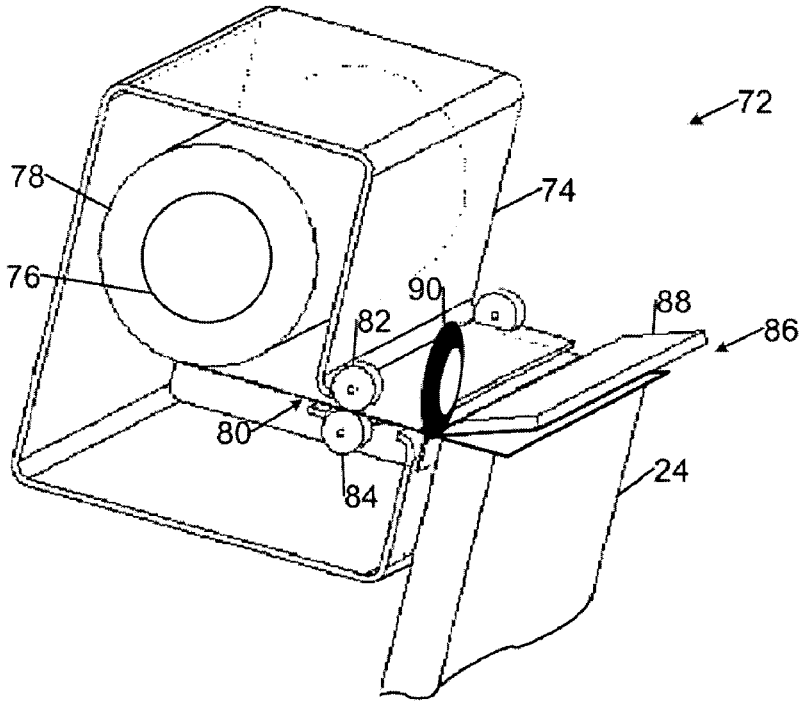
FIG. 4B is a diagrammatic perspective view of the adhesive dispensing system of FIG. 4A disposing a solid hot melt adhesive over a text body spine.
Figure 4C:
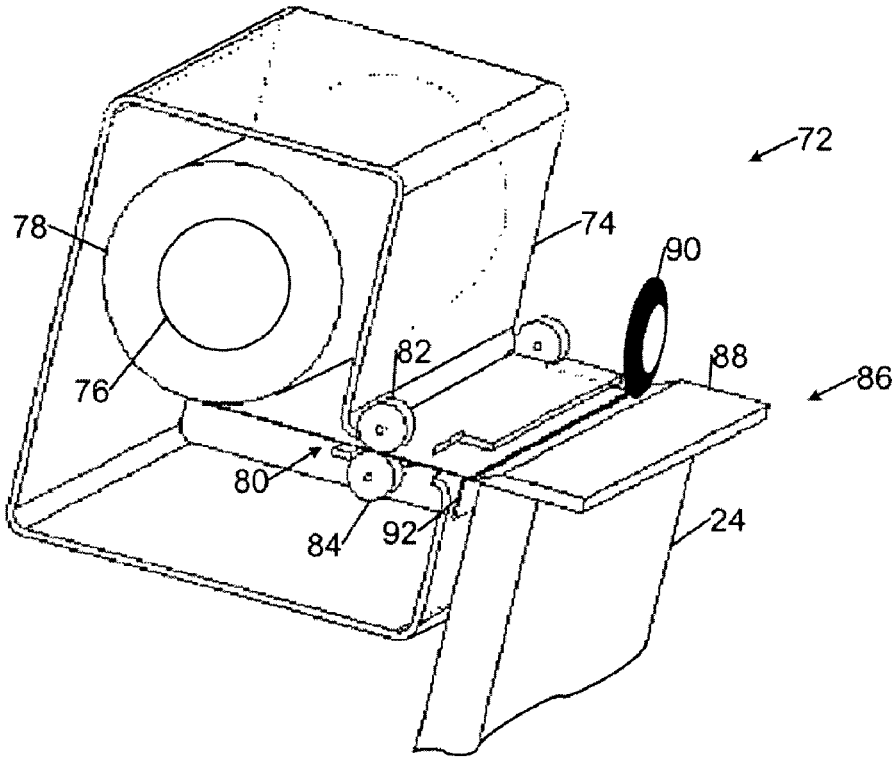
FIG. 4C is a diagrammatic perspective view of the spot heater of FIG. 4A tacking the dispensed solid hot melt adhesive to the text body spine and a cutting wheel cutting the tacked adhesive to width.
Figure 4D:
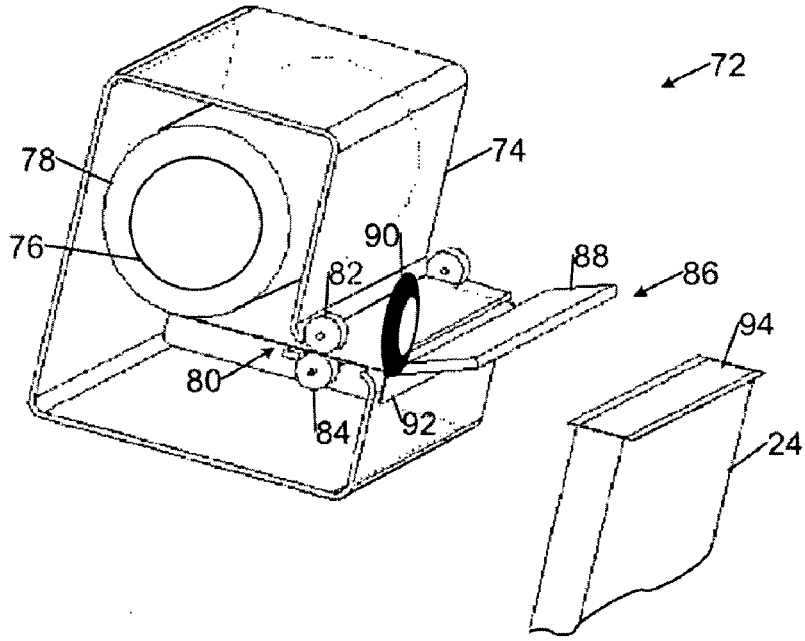
FIG. 4D is a diagrammatic perspective view of the adhesive dispensing system of FIG. 4A and a preformed solid hot melt adhesive tacked to the text body spine.

As shown in FIG. 4B, in operation, adhesive dispensing system 72 is brought into contact with a clamping system (not shown) that holds text body 24 in place. Drive wheels 82, 84 dispense hot melt adhesive 78 over text body spine 34 to a desired width. In one embodiment, an optical sensor may be configured to stop drive rollers 82, 84 upon detecting when the leading edge of hot melt adhesive 78 has passed over text body spine 34 by a desired amount. Referring to FIG. 4C, after hot melt adhesive 78 has been disposed over text body spine 34, spot heater 86 clamps hot melt adhesive 78 to text body spine 34 and cutting wheel 90 cuts hot melt adhesive 78 to width. Spot heater 86 holds hot melt adhesive 78 in place while the adhesive is being cut and applies sufficient heat and pressure to tack the adhesive to text body spine 34 at one or more locations. After hot melt adhesive 78 has been tacked in place, the heating elements of spot heater 86 may be turned off and adhesive dispensing system 72 may be withdrawn (FIG. 4D). The resulting tack bond holds preformed hot melt adhesive 94 to text body spine 34 with sufficient force to prevent preformed hot melt adhesive 94 from becoming displaced during subsequent processing steps and to prevent the sheets of text body 24 from moving.

Referring to FIGS. 5A–7, in one embodiment, preformed hot melt adhesive 94 is processed by a compact, multi-function sheet binder 100 that includes a tool carrier 102 with at least three sides 104, 106, 108 respectively supporting an adhesive heater 110, an adhesive former 112, and an adhesive cooler 114. Tool carrier 102 is configured to rotate about a rotational axis to expose preformed hot melt adhesive 94 to a respective side 104–108 of tool carrier 102. In sequence, each side 104–108 of tool carrier 102 provides a different function in the binding process by presenting a respective tool to act upon the adhesive 94, which is tacked to text body spine 34. In operation, a pair of brackets (not shown) may support multi-function sheet binder 100 over preformed hot melt adhesive 94.

Figure 5A:
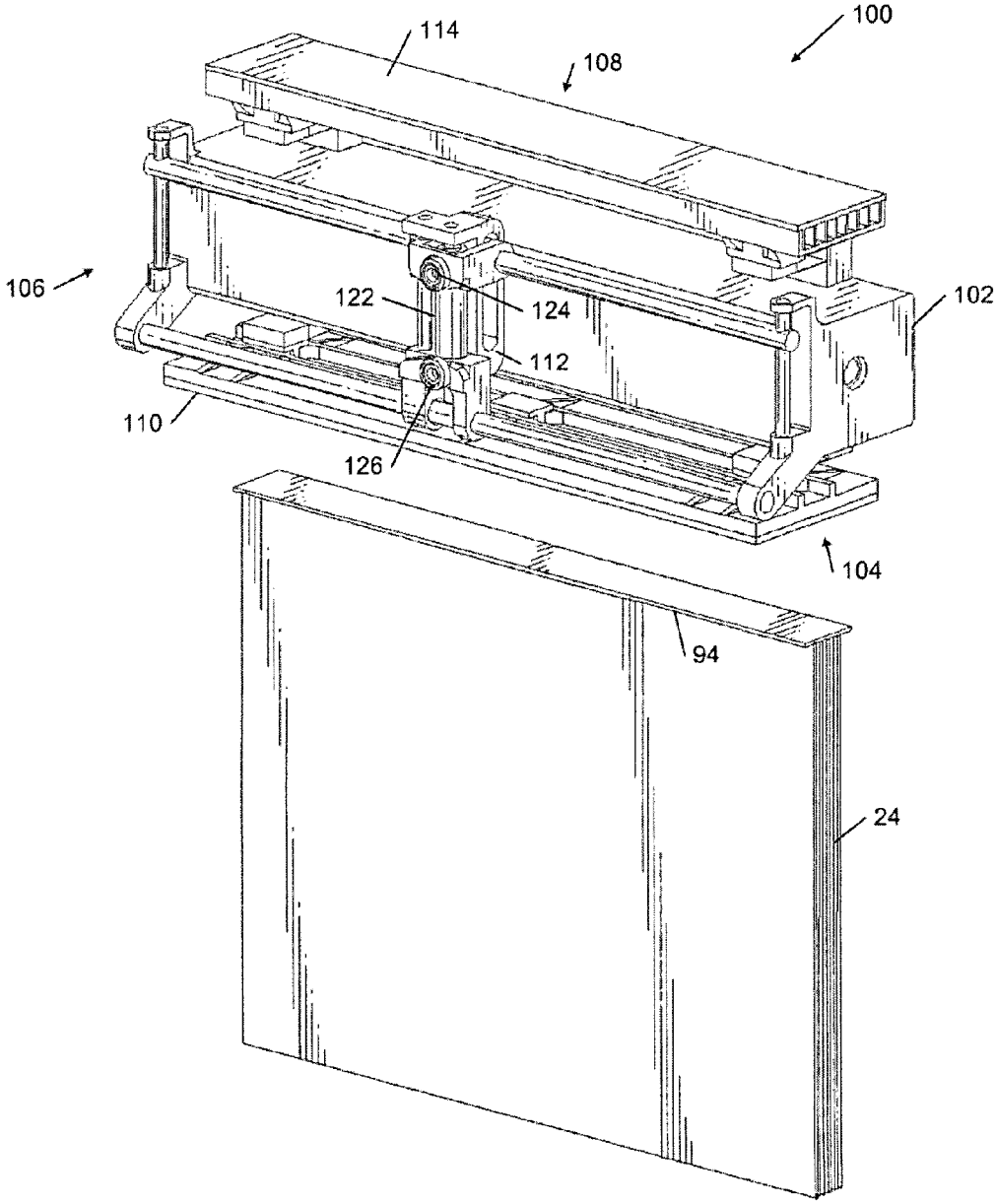
FIG. 5A is a diagrammatic perspective view of a multi-function sheet binder raised above the text body spine of FIG. 4D and oriented to heat the tacked solid hot melt adhesive to a melting temperature.
Figure 5B:
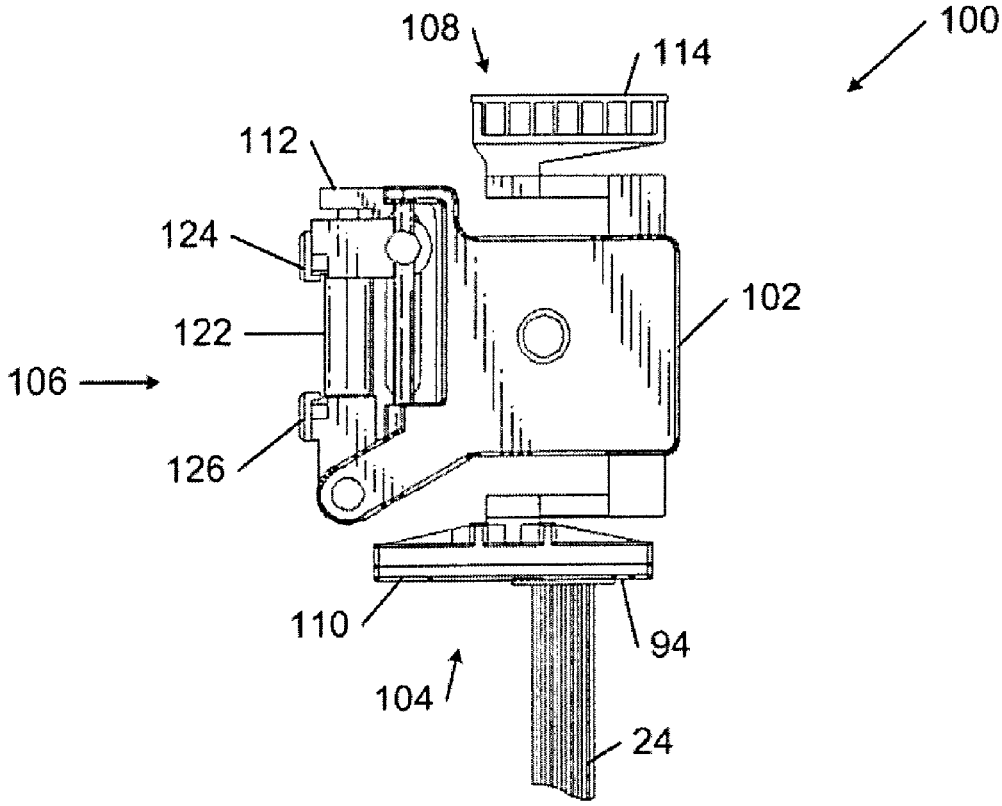
FIG. 5B is a diagrammatic side view of the multi-function sheet binder of FIG. 5A in contact with the text body spine of FIG. 4D and oriented to heat the tacked solid hot melt adhesive to a melting temperature.

As shown in FIGS. 5A and 5B, preformed hot melt adhesive 94 is heated to a melting temperature by orienting side 104 of tool carrier 102 so that adhesive heater 110 is disposed over text body spine 34 and by pressing adhesive heater 110 against the exposed surface of preformed hot melt adhesive 94. Adhesive heater 110 may include a strip heater or other heating device that is configured to heat preformed hot melt adhesive 94 to a temperature at or above the melting temperature of the adhesive. In operation, multi-function sheet binder 100 may be lowered into position over text body spine 34 until adhesive heater 110 contacts and applies a desired pressure to the exposed surface of preformed hot melt adhesive 94. Adhesive heater 110 is removed after hot melt adhesive 94 has melted.

Figure 6A:
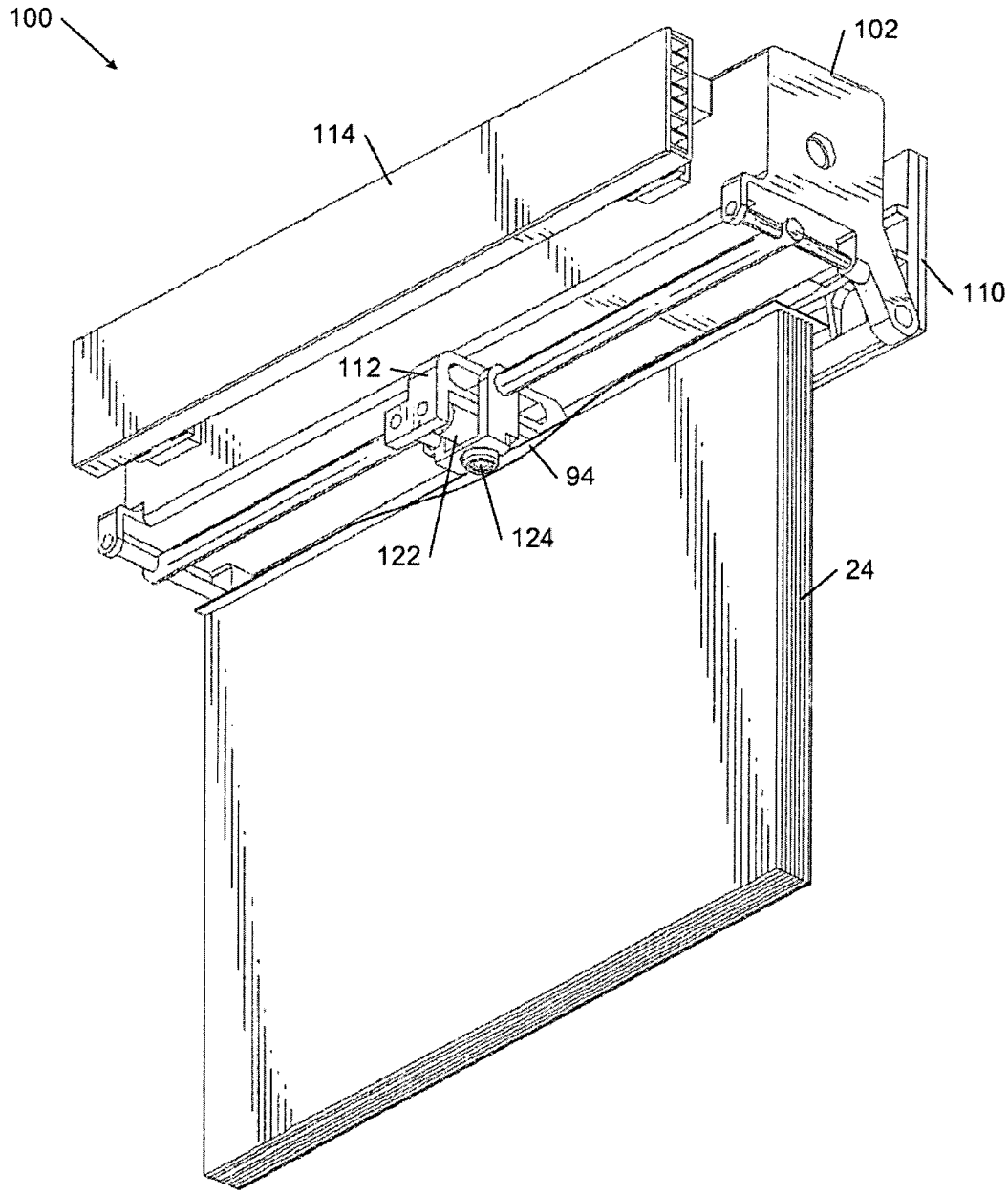
FIGS. 6A–6C are diagrammatic perspective views of the multi-function sheet binder of FIG. 5A applying an adhesive former to the text body spine of FIG. 5B to form the melted adhesive to the text body spine.
Figure 6B:
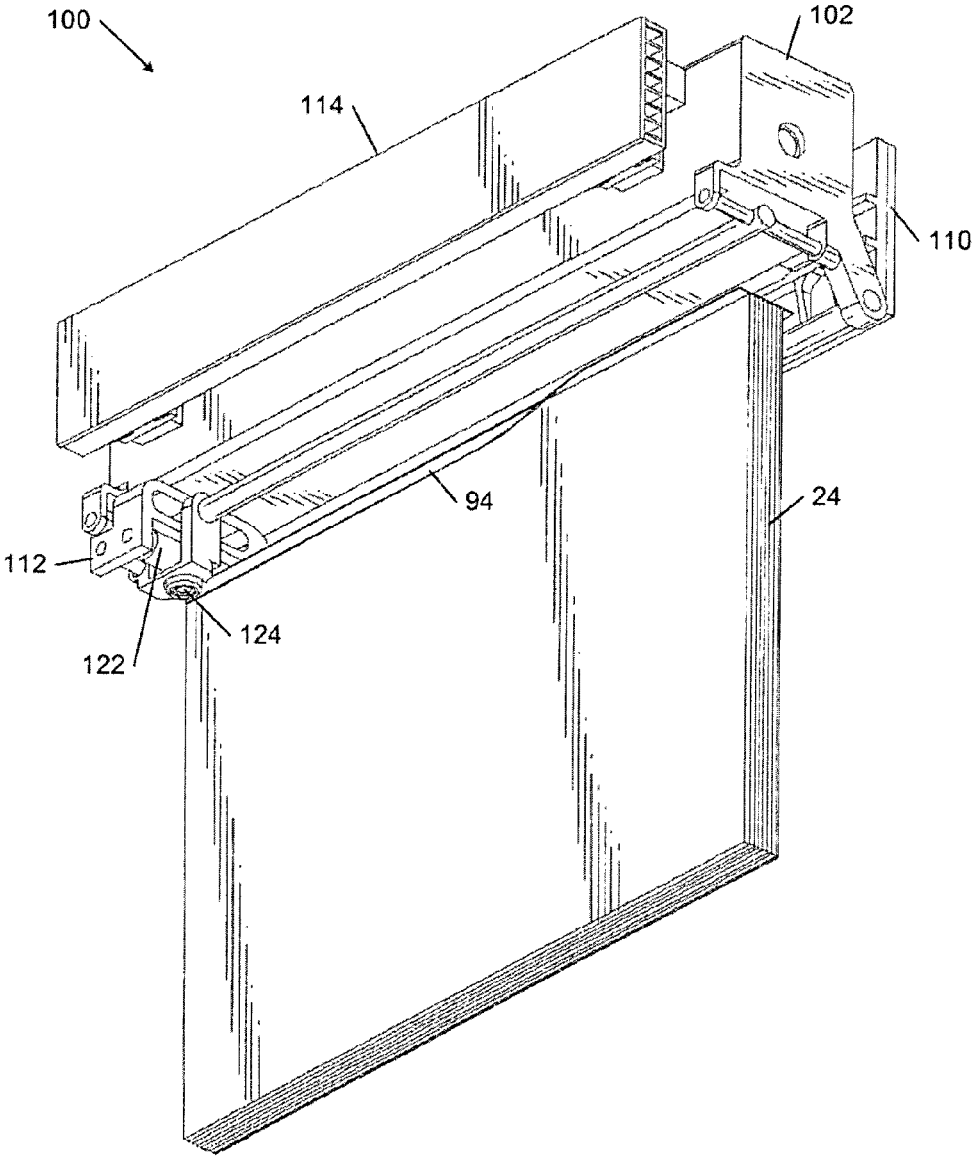
Figure 6C:
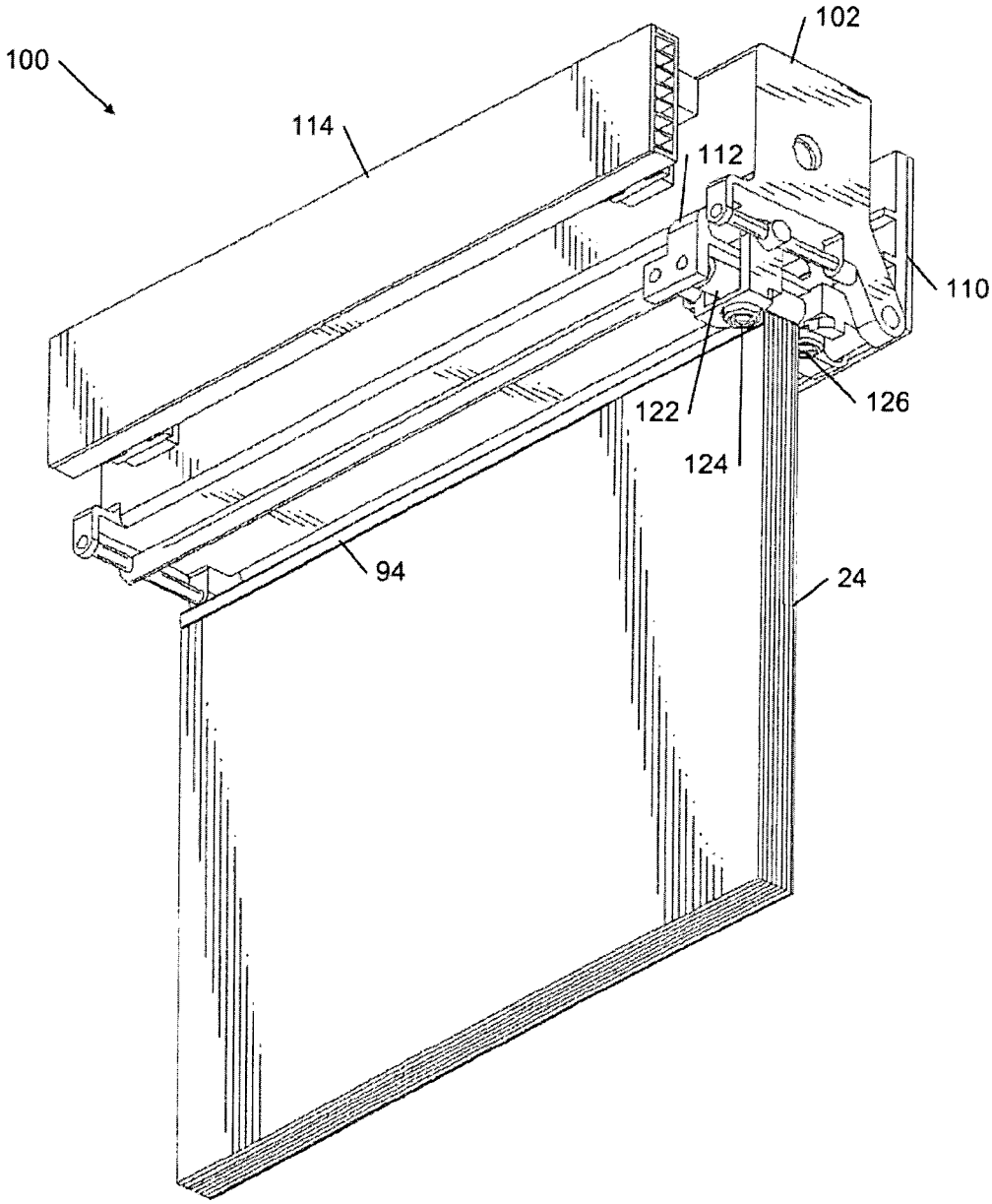

Referring to FIGS. 6A, 6B, and 6C, after preformed hot melt adhesive 94 is melted, multi-function sheet binder 100 may be raised above text body spine 34 and rotated about the rotational axis so that adhesive former 112 is disposed over preformed hot melt adhesive 94. Adhesive former 112 may include a compliant roller 122 that is configured to press a localized region of preformed hot melt adhesive 94 into text body spine 34. Adhesive former 112 also includes a pair of pinch rollers 124, 126 that are configured to fold down localized edge regions of preformed hot melt adhesive 94 into contact with the outer sheets of text body 24. In one embodiment, hot melt adhesive 94 contacts a region of the outer text body sheets that extends from the spine edge a distance that is on the order of 4–5 mm. In operation, adhesive former 112 is positioned over a centrally located region of text body spine 34 to reduce adhesive build-up during the forming process. Compliant roller 122 is lowered into contact with preformed hot melt adhesive 94 to apply a sufficient load to the exposed adhesive surface to form a local region of adhesive 94 to text body spine 34. In addition, pinch rollers 124, 126 are moved toward each other until the local edge regions of preformed hot melt adhesive 94 are folded down into contact with text body 24 (FIG. 6A). Adhesive former 112 forms the remaining portions of preformed hot melt adhesive 94 to text body spine 34 by traversing a continuous path 128 that leads from the centrally located region of text body spine 34, to one spine end, to the other spine end, and back to the centrally located region of text body spine 34 (FIGS. 6B and 6C). In this way, adhesive former passes over the entirety of preformed hot melt adhesive two times.

Figure 7:
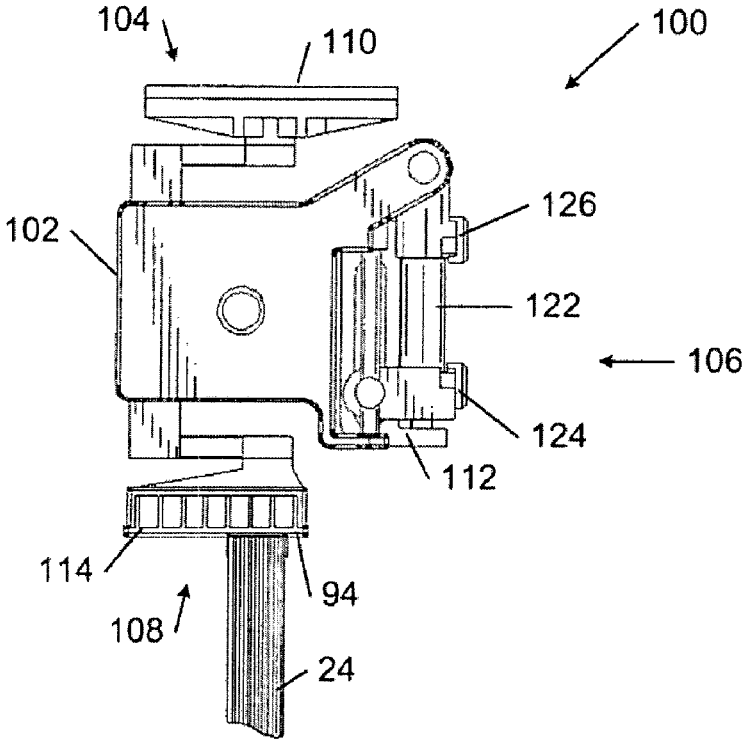
FIG. 7 is a diagrammatic side view of the multi-function sheet binder of FIG. 5A in contact with the text body spine of FIG. 6B and oriented to apply an adhesive cooler to the adhesive formed to the text body spine.
Figure 8:
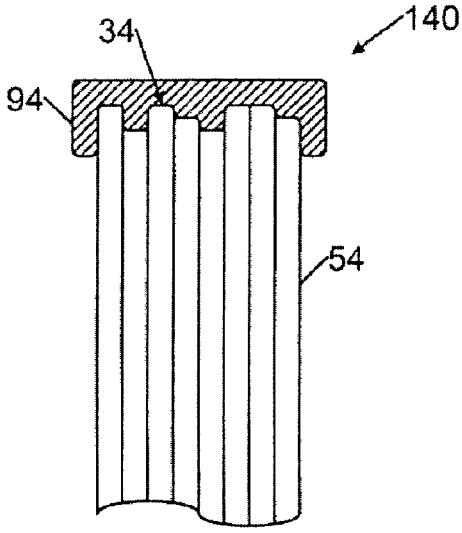
FIG. 8 is a diagrammatic end view of the spinal portion of a bound text body.

Referring to FIGS. 7 and 8, after preformed hot melt adhesive 94 is formed to text body spine 34, multi-function sheet binder 100 may be raised above text body spine 34 and rotated about the rotational axis so that adhesive cooler 114 is disposed over hot melt adhesive 94. Adhesive cooler 114 may include a conventional heat sink that is formed from a thermally conductive material (e.g., aluminum). In some embodiments, adhesive cooler 114 also may include a fan that is configured to direct a flow of air over the heat fins of heat sink to transfer heat from heat sink to the flowing air. In operation, multi-function sheet binder 100 may be lowered into position over text body spine 34 until adhesive cooler 114 contacts and applies a desired pressure to the exposed surface of formed hot melt adhesive 94. After formed hot melt adhesive 94 has re-solidified to bind the text body sheets into a bound text body 140 (FIG. 8), multi-function sheet binder 100 may be raised above text body spine 34 and the bound text body 140 may be subjected to one or more additional processing steps. For example, a cover may be attached to the bound text body as described in co-pending U.S. patent application Ser. No. 09/721,549 filed Nov. 24, 2000, by Robert L. Cobene et al., and entitled "SYSTEMS AND METHODS OF ATTACHING A COVER TO A TEXT BODY," which is incorporated herein by reference.

In sum, the above-described embodiments incorporate novel systems and methods for binding a text body in a manner that may improve the performance and cost-effectiveness of desktop and office on-demand bookbinding systems.

Other embodiments are within the scope of the claims.

For example, although in the above-described embodiments the preformed hot melt adhesive is heated by a contact heater, other methods of heating the adhesive may be used. In some embodiments, a radiant heater (e.g., a tungsten core quartz lamp) may be used to melt the hot melt adhesive.

In some embodiments, the binding functions performed by adhesive heater 110, adhesive former 112 and adhesive cooler 114 may be provided by separate tools that are arranged in a process line along which the text body and preformed hot melt adhesive 94 may be conveyed. In these embodiments, each binding tool may operate upon preformed hot melt adhesive 94 in a linear process sequence.

Still other embodiments are within the scope of the claims.

What is claimed is:

1. A system of binding sheets into a bound text body, comprising:

a multi-function sheet binder configured to heat a preformed solid hot melt adhesive to a melting temperature, form the melted adhesive by pressing the melted adhesive into a spine of a text body and folding down edges of the melted adhesive into contact with the text body, and actively cool the formed adhesive.

2. The system of claim 1, wherein the multi-function sheet binder comprises a tool carrier having separate sides respectively supporting one of an adhesive heater tool, an adhesive former tool and an adhesive cooler tool.

3. A system of binding sheets into a bound text body, comprising:

a spot heater configured to heat one or more localized areas of a solid hot melt adhesive to a temperature sufficient to tack the hot melt adhesive to a text body spine without melting other areas of the hot melt adhesive.

4. The system of claim 3, wherein the spot heater comprises an elongated clamp supporting one or more spaced apart heating elements.

5. A system of binding sheets into a bound text body, comprising:

an adhesive former configured to sequentially press localized region of a preformed heated solid hot melt adhesive into a spine of a text body at different respective times, wherein each localized region is pressed without simultaneously pressing other regions of the hot melt adhesive into the spine, the adhensive former being further configured to sequentially fold down localized edge regions of the preformed solid hot melt adhesive into contact with the text body.

6. The system of claim 5, wherein the adhesive former comprises a compliant roller configured to press the localized region of the preformed heated solid hot melt adhesive into the text body spine.

7. The system of claim 5, wherein the adhesive former is configured to traverse the text body spine.

8. A method of binding sheets into a bound text body, comprising:

dispensing a solid hot melt adhesive over a spine of a text body;

heating one or more localized areas of the dispensed adhesive to a temperature sufficient to tack the hot melt adhesive to the text body spine without melting other areas of; the hot melt adhesive; and cutting the tacked adhesive to width.

9. The method of claim 8, further comprising heating the cut adhesive to a melting temperature.

10. The method of claim 9, further comprising forming the melted adhesive by pressing the melted adhesive into the text body spine and folding down edges of the melted adhesive into contact with the text body.

11. The method of claim 10, wherein a localized region of the melted adhesive is formed and, subsequently, remaining regions of the melted adhesive are formed.

12. The system of claim 1, wherein the multi-function sheet binder is configured to actively cool the formed adhesive by contacting the formed adhesive with an adhesive cooler.

13. The system of claim 12, wherein the adhesive cooler comprises a heat sink with multiple heat fins.

14. The system of claim 13, wherein the adhesive cooler comprises a fan configured to direct a flow of air over the heat fins of the heat sink.

15. The system of claim 1 incorporated into a desktop bookmaking system.

16. The system of claim 4, wherein the elongated clamp supports multiple spaced apart heating elements.

17. The system of claim 16 wherein adjacent pairs of heating elements are spaced apart by respective distances on the order of 1–4 cm.

18. The system of claim 3, further comprising a cutting wheel operable to cut the hot melt adhesive.

19. The system of claim 18, wherein the system is configured so that the spot heater holds the hot melt adhesive in place over the text body while the cutting wheel cuts the hot melt adhesive.

20. The system of claim 19, wherein the system is configured so that the spot heater applies sufficient heat and pressure to tack the hot melt adhesive to the text body spine at one or more locations while the spot heater holds the hot melt adhesive in place.

21. The system of claim 3 incorporated into a desktop bookmaking system.

22. The system of claim 5, wherein the system is configured to position the adhesive former in contact with an area of the preformed hot melt adhesive disposed over a centrally located region of the text body spine.

23. The system of claim 22, wherein the system is configured to move the adhesive former along a continuous path leading from the centrally located region of the text body spine, to a first spine end region, to a second spine end region, and back to the centrally located region of the text body spine.

24. The system of claim 5 incorporated into a desktop bookmaking system.

25. The method of claim 8, wherein multiple spaced apart localized areas of the dispensed adhesive are heated to a temperature sufficient to tack the adhesive to the text body spine.

26. The method of claim 25, wherein adjacent pairs of the localized areas of the dispensed adhesive are spaced apart by respective distances on the order of 1–4 cm.

27. The method of claim 10, wherein the melted adhesive is formed by positioning an adhesive former in contact with an area of the preformed hot melt adhesive disposed over a centrally located region of the text body spine, and moving the adhesive former along a continuous path leading from the centrally located region of the text body spine, to a first spine end region, to a second spine end region, and back to the centrally located region of the text body spine.

28. The method of claim 9, further comprising actively cooling the formed hot melt adhesive.

29. The method of claim 8, wherein the hot melt adhesive is cut while the hot melt adhesive is being heated.

* * * * *